US006293831B1

(12) United States Patent
Yamatani

(10) Patent No.: US 6,293,831 B1
(45) **Date of Patent: *Sep. 25, 2001**

(54) ELECTRIC CONNECTOR

(75) Inventor: Eiji Yamatani, Tokyo (JP)

(73) Assignee: Calsonic Kansei Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/292,932

(22) Filed: Apr. 16, 1999

(30) Foreign Application Priority Data

Apr. 16, 1998 (JP) ..... 10-106468

(51) Int. Cl.[7] ..... H01R 11/22
(52) U.S. Cl. ..... 439/850; 439/849
(58) Field of Search ..... 439/849, 850, 439/843

(56) References Cited

U.S. PATENT DOCUMENTS 3,660,806 * 5/1972 De Stephan ..... 439/850

FOREIGN PATENT DOCUMENTS

2271224 A * 4/1994 (GB) ..... 439/850
52-12947 3/1977 (JP) .
6-33373 4/1994 (JP) .

* cited by examiner

*Primary Examiner*—Renee Luebke
*Assistant Examiner*—Briggitte R. Hammond
(74) *Attorney, Agent, or Firm*—Foley & Lardner

(57) ABSTRACT

An electric connector comprises a male terminal member and a female terminal member. The female terminal member includes a female portion into which a male portion of the male terminal member can be slidably inserted. The female portion is symmetrical with respect to a longitudinal axis of the female terminal member. The female portion includes a base wall portion, side wall portions which extend upward from lateral ends of the base wall portion, upper wall portions which extend toward each other from upper ends of the side wall portions and bent back portions which extend laterally outward from inward ends of the upper wall portions below the upper wall portions. Front ends of the bent back portions are slanted in a direction away from the longitudinal axis thereby to constitute guide slopes for facilitating insertion of the male portion of the male terminal member into the female portion of the female terminal member.

10 Claims, 4 Drawing Sheets

ELECTRIC CONNECTOR

BACKGROUND OF THE INVENTION

1. Field of the Invention

The present invention relates in general to electric connectors and particularly to electric connectors of a type comprising male and female terminal members which are to be coupled when electric connection therebetween is needed. More specifically, the present invention is concerned with the female terminal member which is constructed to smoothly receive therein the male terminal member upon requirement of the electric connection therebetween.

2. Description of the Prior Art

In order to clarify the task of the present invention, known electric connectors of the above-mentioned type will be briefly described with reference to the accompanying drawings.

One of such electric connectors is shown in Japanese Utility Model Second Provisional Publication (Jikkosho) 52-12947, which is shown in FIGS. 5 and 6 of the accompanying drawings as being designated by numeral 100. The connector 100 generally comprises a male terminal member 1 and a female terminal member 2, each being constructed of a metal plate. When it is needed to establish an electric connection therebetween, the male terminal member 1 is inserted into the female terminal member 2. As shown in FIG. 5, the female terminal member 2 includes a wire gripping portion 4 by which a naked end of a wire 3 is gripped and a female portion 5 into which a male portion 1*a* of the male terminal member 1 can be inserted. The female portion 5 includes a base wall portion 6 and a pair of cylindrical side portions 7*a* and 7*b* integrally formed on respective side ends of the base wall portion 6. Each of the cylindrical side portions 7*a* and 7*b* has an inwardly curled end 8*a* or 8*b* which is spaced from the base wall portion 6 by a given distance which is somewhat smaller than the thickness of the male portion 1*a* of the male terminal member 1. Thus, a mouth or socket portion 9 is defined by the base wall portion 6 and the inwardly curled ends 8*a* and 8*b*. When the male portion 1*a* of the male terminal member 1 is inserted into the mouth portion 9 of the female terminal member 2, the inwardly curled ends 8*a* and 8*b* of the female terminal member 2 resiliently press the male portion 1*a* against the base wall portion 6 thereby to achieve a tight connection therebetween. However, in this known electric connector 100, the two terminal members 1 and 2 should be precisely aligned before making their coupling. That is, if the precise alignment is not provided, the two terminal members 1 and 2 would come into interference with each other at their leading ends, which causes a troublesome coupling work of them.

For eliminating such drawback, another electric connector has been proposed by Japanese Utility Model First Provisional Application (Jikkaihei) 6-38373, which is shown in FIGS. 7 and 8 of the accompanying drawings as being designated by numeral 200. It is to be noted that FIG. 7 is a partially cut perspective view of a female terminal member of the connector 200. The connector 200 generally comprises a male terminal member 1 (see FIG. 8) and the female terminal member 2, each being constructed of a metal plate. As shown in FIG. 7, the female terminal member 2 includes a wire gripping portion 4 by which a naked part of a wire (not shown) is gripped and a female portion 5 into which a male portion 1*a* (see FIG. 8) of the male terminal member 1 can be inserted. The female portion 5 includes a base wall portion 6, two elongate projections 10*a* and 10*b* formed on the base wall portion 6 and a pair inwardly curled side wall portions 7*a* and 7*b* (only one 7*b* is shown) integrally formed on respective side ends of the base wall portion 6. Each of the side wall portions 7*a* and 7*b* has at its inwardly leading end a bent back portion 11*a* or 11*b* which is spaced from a top of the corresponding elongate projection 10*a* or 10*b* by a given distance which is somewhat smaller than the thickness of the male portion 1*a* of the male terminal member 1. Each bent back portion 11*a* or 11*b* has an upwardly curved front end 11*a*' or 11*b*'. A mouth or socket portion 9 is defined by front ends of the inwardly curled side wall portions 7*a* and 7*b*. When the male portion 1*a* of the male terminal member 1 is inserted into the mouth portion 9 of the female terminal member 2, the bent back portions 11*a* and 11*b* of the female terminal member 2 resiliently press the male portion 1*a* against the elongate projections 10*a* and 10*b* thereby to achieve a tight connection therebetween. Due to provision of the upwardly curved front ends 11*a*' and 11*b*' of the bent back portions 11*a* and 11*b*, the coupling between the two terminal members 1 and 2 is readily and smoothly carried out. That is, even if the two terminal members 1 and 2 fail to be precisely aligned before their coupling, they can be easily coupled by only making a slight relative displacement therebetween. However, even the electric connector 200 has the following drawback. That is, providing the bent back portions 11*a* and 11*b* with the upwardly curved front ends 11*a*' and 11*b*' needs a very difficult production technique and thus brings about increase in cost of the electric connector 200.

SUMMARY OF THE INVENTION

It is therefore an object of the present invention to provide an electric connector which is free of the above-mentioned drawbacks.

According to the present invention, there is provided an electric connector which is simple in construction and economical.

According to the present invention, there is provided an electric connector comprising male and female terminal members which can be easily coupled with a simple coupling work.

According to the present invention, there is provided an electric connector which comprises a male terminal member having a male portion; and a female terminal member including a female portion into which the male portion can be slidably inserted, the female portion being symmetrical with respect to a longitudinal axis of the female terminal member, the female portion including a base wall portion, side wall portions which extend upward from lateral ends of the base wall portion, upper wall portions which extend toward each other from upper ends of the side wall portions and bent back portions which extend laterally outward from inward ends of the upper wall portions below the upper wall portions, wherein front ends of the bent back portions are slanted in a direction away from the longitudinal axis thereby to constitute guide slopes for facilitating insertion of the male portion of the male terminal member into the female portion of the female terminal member.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 2:
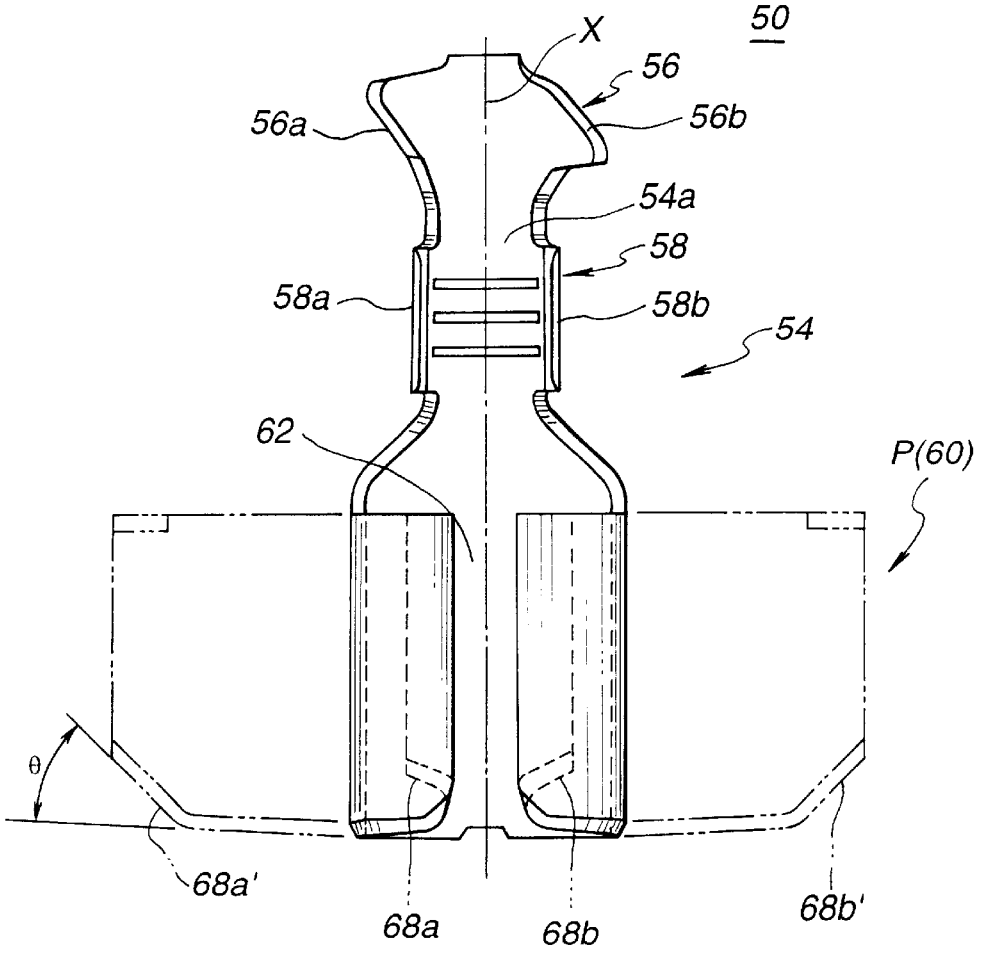
FIG. 2 is a plan view of a blank of the female terminal member, which is produced by a press machine.
Figure 3:
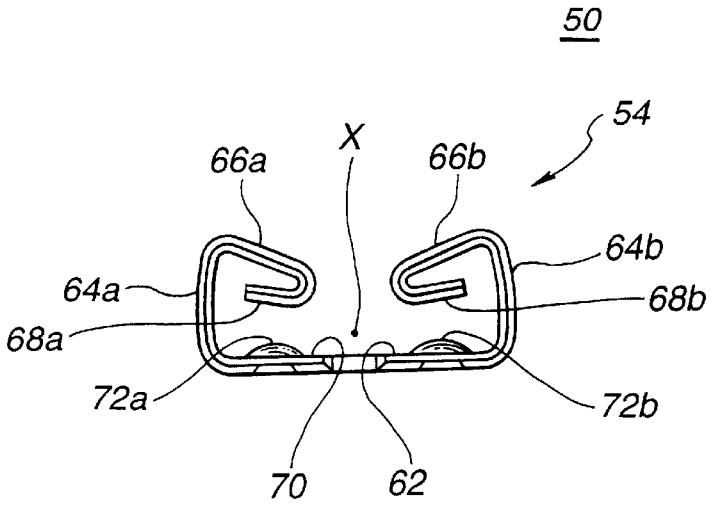
FIG. 3 is a laterally sectioned view of the female terminal member of the electric connector according to the present invention.
Figure 4:
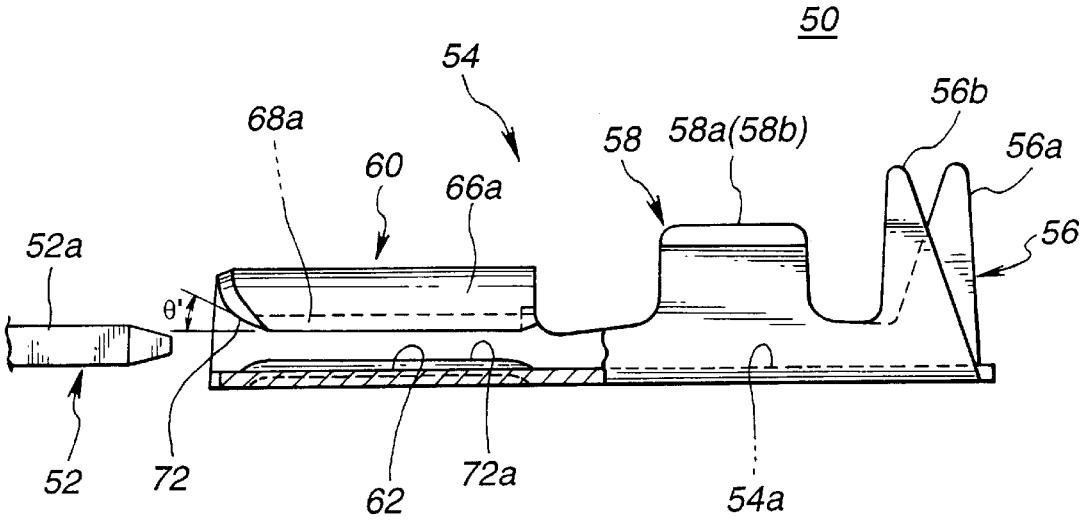
FIG. 4 is a longitudinally sectioned view of the female terminal member of the electric connector according to the present invention.
Figure 5:
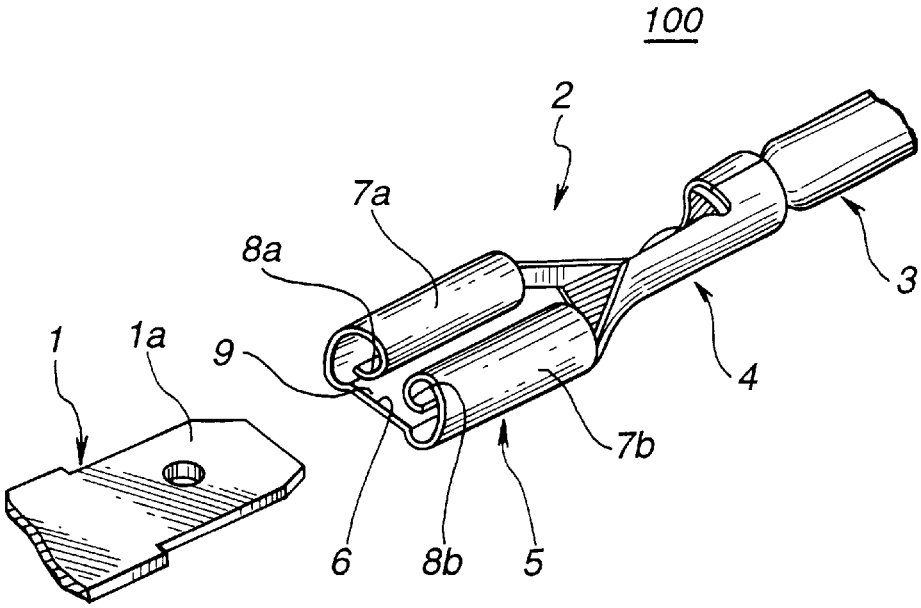
FIG.5 (PRIOR ART)
FIG. 5 is an enlarged perspective of a first known electric connector.
Figure 6:
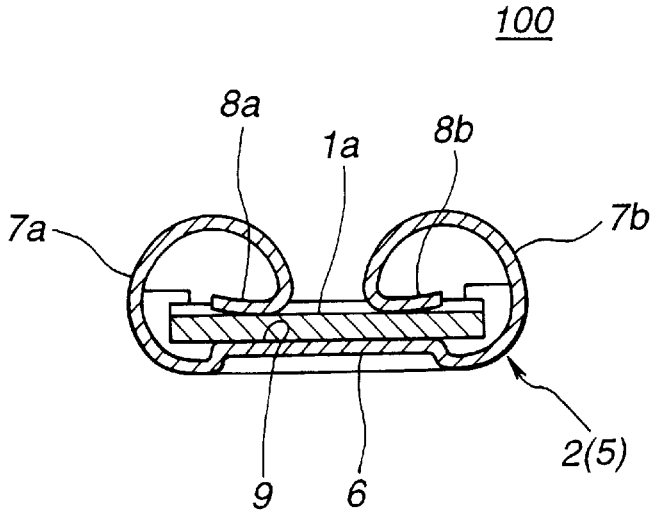
FIG.6 (PRIOR ART)
FIG. 6 is a laterally sectioned view of a female terminal member of the first known electric connector.
Figure 7:
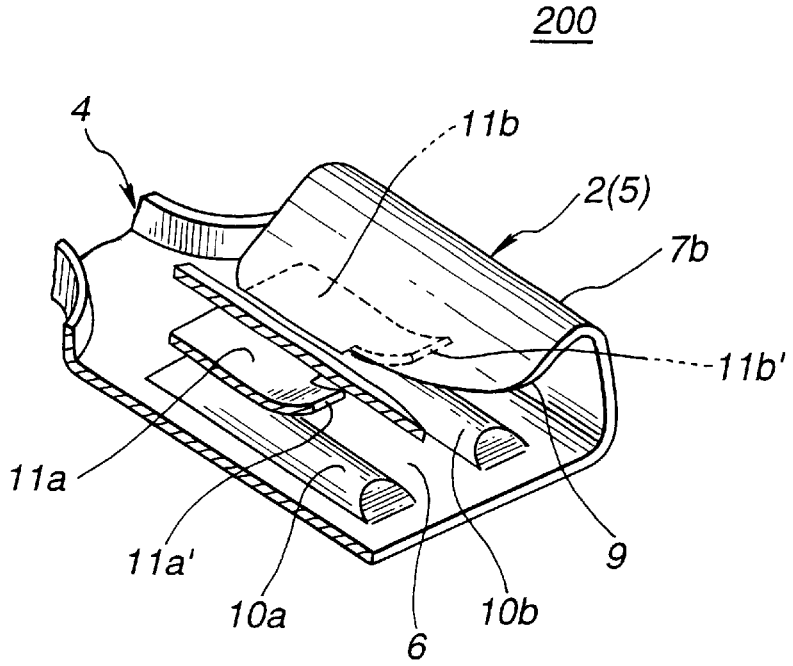
FIG.7 (PRIOR ART)
FIG. 7 is a partially cut perspective view of a female terminal member of a second known electric connector.
Figure 8:
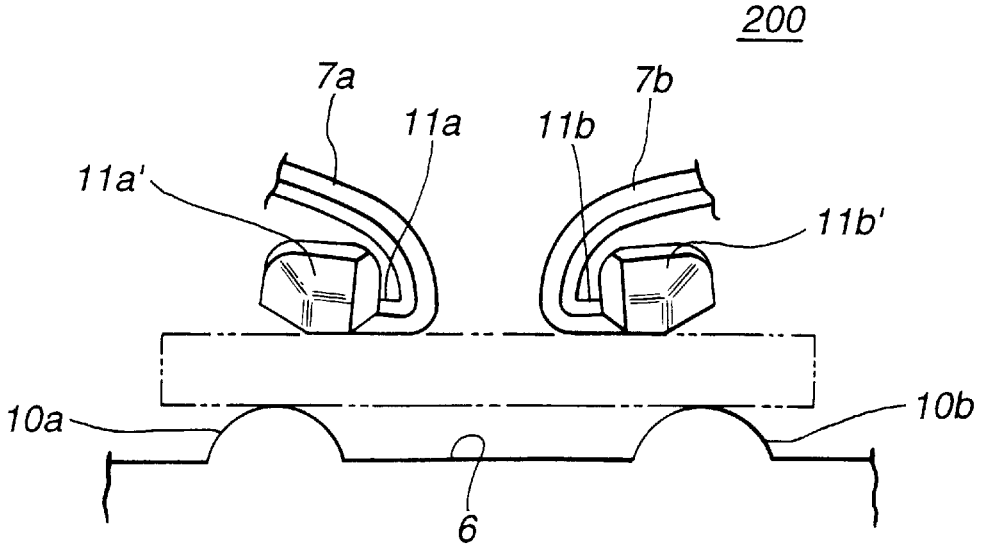
FIG.8 (PRIOR ART)
FIG. 8 is a partial enlarged laterally sectioned view of the female terminal member of the second known electric connector.

Referring to FIGS. 1 to 4, particularly FIG. 4, there is shown an electric connector 50 which generally comprises a male terminal member 52 and a female terminal member 54. The male terminal member 52 is substantially the same as the above-mentioned male terminal member 1 of the known electric connector 100 as shown in FIG. 5. As is seen from the drawing, the two terminal members 52 and 54 are coupled upon requirement of electric connection therebetween.

As is seen from FIG. 2 which shows a blank of the female terminal member 54, the female terminal member 54 is produced by applying press and curling technique to a metal plate. The method of producing the female terminal member 54 will be described hereinafter.

Figure 1:
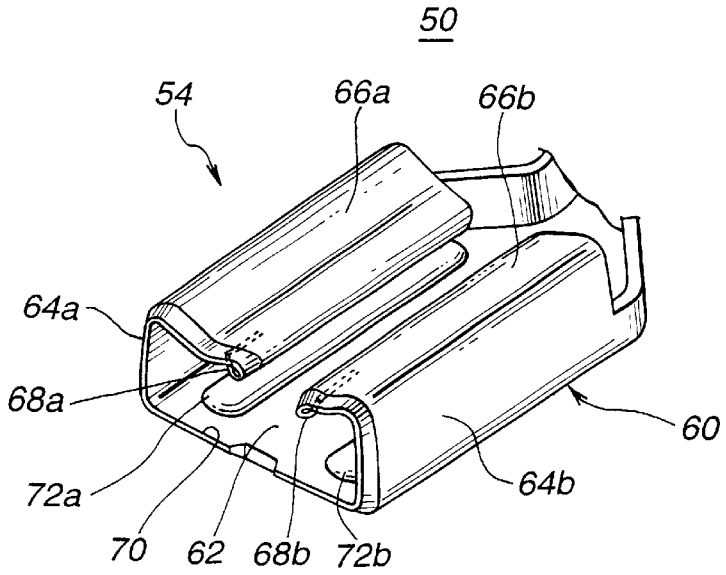
FIG. 1 is a perspective view of a female terminal member of an electric connector according to the present invention.

As is seen from FIGS. 1 and 4, the produced female terminal member 54 comprises generally a wire holding portion 56, a wire gripping portion 58 and a female portion 60 which are aligned on a longitudinal axis "x" of the female terminal member 54 (see FIG. 2). The wire holding portion 56 holds a wire (not shown) and the wire gripping portion 58 grips a naked part of the wire. Each of the wire holding and gripping portions 56 and 58 comprises two mutually facing walls 56*a* and 56*b* (or, 58*a* and 58*b*) which are bent inward to be put on one another having the wire or the naked part of the wire pressed against a bottom wall 54*a*.

As is seen from FIGS. 1 and 3, the female portion 60 is symmetrical with respect to the longitudinal axis "x" and comprises generally a base wall portion 62 which is merged with the above-mentioned bottom wall 54*a* (see FIG. 2), side wall portions 64*a* and 64*b* which extend upward from lateral ends of the base wall portion 62, upper wall portions 66*a* and 66*b* which extend toward each other from upper ends of the side wall portions 64*a* and 64*b* and bent back portions 68*a* and 68*b* which extend laterally outward from inward ends of the upper wall portions 66*a* and 66*b* below the upper wall portions 66*a* and 66*b*.

The base wall portion 62 is formed with two elongate projections 72*a* and 72*b* which face the bent back portions 68*a* and 68*b*. As is seen from FIG. 3, the upper wall portions 66*a* and 66*b* are inclined toward the base wall portion 62.

A mouth or socket portion 70 is thus defined by a front end of the base wall portion 62, front ends of the side wall portions 64*a* and 64*b*, front ends of the upper wall portions 66*a* and 66*b* and front ends of the bent back portions 68*a* and 68*b*. As will be described in detail hereinafter, a male portion 52*a* of the male terminal member 52 is inserted into the mouth portion 70 for establishing electric connection therebetween. Due to provision of the elongate projections 72*a* and 72*b*, insertion of the male portion 52*a* into the mouth portion 70 is smoothly carried out. That is, during insertion, the elongate projections 72*a* and 72*b* serve as rails for the male portion 52*a*.

For facilitating insertion of the male portion 52*a* into the female portion 60, the following measure is employed in the present invention.

That is, the front ends of the bent back portions 68*a* and 68*b* are slanted in a direction away from the longitudinal axis "x". For providing the bent back portions 68*a* and 68*b* with such slanted front ends, the blank (see FIG. 2) of the female terminal member 54 has at corresponding corner portions respective cuts 68*a*' and 68*b*' each having a base edge defining an angle "θ" relative to the front end of the base wall portion 62.

As is seen from FIG. 4, upon production, the slanted front ends of the bent back portions 68*a* and 68*b* constitute guide slopes 72 each being slanted toward the center of the female portion 60 by an angle of "θ'" relative to the base wall portion 62. That is, due to provision of the guide slopes 72, insertion of the male portion 52*a* of the male terminal member 52 into the female portion 60 of the female terminal member 54 is readily and smoothly carried out. That is, the insertion of the male portion 52*a* is guided by the guide slopes 72.

If desired, the upper wall portions 66*a* and 66*b* may be formed with slanted front ends. However, in this case, the front end of each upper wall portion 66*a* or 66*b* is slanted in a direction toward the longitudinal axis "x". Due to provision of the slanted front ends of the upper wall portions 66*a* and 66*b*, the insertion of the male terminal member 52 into the female terminal member 54 is very smoothly and readily made.

Furthermore, if desired, the mouth or socket portion 70 of the female terminal member 54 may be somewhat enlarged in size.

In the following, method of producing the female terminal member 54 will be described with reference to the drawings, particularly FIG. 2.

First, as is seen from FIG. 2, by using a suitable press machine, a blank of the female terminal member 54 is prepared from a flat metal plate, which has such a structure as shown by a phantom line in FIG. 2. That is, the blank has a shaped flat plate portion indicated by reference "P" in the drawing, which is used for producing the female portion 60. It is to be noted that the cuts 68*a* and 68*b* are already produced in the shaped flat plate portion "P".

Then, the blank is set in a bending/curling machine and subjected to bending process and curling process to shape up the female portion 60 having the above-stated structure.

In the following, advantages possessed by the electric connector 50 of the present invention will be described.

First, due to provision of the guide slopes 72 provided by the slanted front ends of the bent back portions 68*a* and 68*b*, insertion of the male terminal member 52 into the female terminal member 54 is readily and smoothly carried out. That is, even if the two terminal members 52 and 54 fail to be precisely aligned before their coupling, they can be easily and quickly coupled by only making a slight relative displacement therebetween. This advantage becomes much assured when the upper wall portions 66*a* and 66*b* have slanted front ends.

Second, production of the guide slopes 72 can be made with ease as has been described hereinabove, which brings about economical production of the electric connector 50.

Third, due to provision of the elongate projections 72*a* and 72*b* of the female terminal member 54, insertion of the male terminal member 52 into the female terminal member 54 is smoothly made with smaller force. Upon complete coupling of the two terminal members 52 and 54, the bent back portions 68*a* and 68*b* resiliently press the male portion 52*a* against the base wall portion 62 of the female terminal member 54 thereby to achieve a tight connection therebetween.

The entire contents of Japanese Patent Application P10-106468 (filed Apr. 4, 1998) are incorporated herein by reference.

Although the invention has been described above by reference to a certain embodiment of the invention, the invention is not limited to the embodiment described above. Modifications and variations of the embodiment described above will occur to those skilled in the art, in light of the above teachings.

What is claimed is:

1. An electric connector comprising:

a male terminal member having a male portion; and a female terminal member including a female portion into which said male portion can be slidably inserted, said female portion being symmetrical with respect to a longitudinal axis of said female terminal member, said female portion including a base wall portion, side wall portions which extend upward from lateral ends of said base wall portion, upper wall portions which extend toward each other from upper ends of said side wall portions and bent back portions which extend laterally outward from the inward ends of said upper wall portions and which are disposed below said upper wall portions, wherein said bent back portions are inclined toward the corresponding upper wall portions in such a manner that a distance between each bent back portion and said base wall portion gradually increases as the bent back portion nears the corresponding side wall portion, wherein front ends of the inclined bent back portions are slanted in a direction away from said longitudinal axis so as to form slanted front ends, so that the front end of each bent back portion is underneath and does not extend as forward as the corresponding upper wall portion thereby to constitute guide slopes for facilitating insertion of said mail portion of the male terminal member into said female portion of the female terminal member, wherein the slanted front ends of the inclined bent back portions are provided by cutting off, along a straight line, front side corners of a blank of said female terminal member, bending lateral outside portions of the blank to constitute said inclined bent back portions having said slanted front ends, and bending lateral inside portions of the blank to constitute said side wall portions and said upper wall portions, and wherein the slanted front ends of the inclined bent back portions constitute guide slopes that are slanted at a predetermined angle with respect to an angle at which said male portion is inserted into said female portion.

2. The electric connector as claimed in claim 1, in which said slanted front ends of said bent back portions are provided by cutting corresponding portions of a blank of said female terminal member.

3. The electric connector as claimed in claim 1, in which said female terminal member further includes:

a wire holding portion for holding a wire; and a wire gripping portion for gripping a naked part of said wire, wherein each of said wire holding and gripping portions includes two mutually facing walls which are bent inward to be put on one another.

4. The electrical connector as claimed in claim 1, wherein each of the inclined bent back portions are disposed on a corresponding single planar surface.

5. The electric connector as claimed in claim 1, in which front ends of said upper wall portions are slanted toward said longitudinal axis.

6. The electric connector as claimed in claim 5, in which said upper wall portions are inclined toward said base wall portion.

7. The electric connector as claimed in claim 1, in which said base wall portion is formed with elongate projections which face said bent back portions.

8. The electrical connector as claimed in claim 7, wherein a distance between each of the inclined bent back portions and the corresponding elongate projections is a same distance along an entire first and second cross-sectional paths of the inclined bent back portions, respectively, the first and second cross-sectional paths being parallel to the longitudinal axis of said female terminal member and the first and second cross-sectional paths passing through the inclined bent back portions.

9. An electrical connector as claimed in claim 1, wherein the slanted front ends of the inclined bent back portions are disposed in a manner such that said male portion makes contact with a first portion of said slanted front ends before making contact with a second portion of said slanted front ends that is disposed closer to said side wall portions.

10. An electrical connector as claimed in claim 9, wherein the slanted front ends are slanted at an offset angle greater than 0 degrees and less than 90 degrees, with respect to an edge of said blank that corresponds to a front edge of said upper wall portions.

* * * * *